US005709633A

United States Patent [19]

Sokol

[11] Patent Number: 5,709,633

[45] Date of Patent: Jan. 20, 1998

[54] RECIPROCATING EXERCISE MACHINE

[76] Inventor: Steven D. Sokol, 414 Beckham Dr., San Jose, Calif. 95123

[21] Appl. No.: 827,933

[22] Filed: Jan. 28, 1997

[51] Int. Cl.[6] ..... A63B 69/06; A63B 21/00

[52] U.S. Cl. ..... 482/62; 482/51; 482/142

[58] Field of Search ..... 482/62, 57, 51, 482/52, 53, 60, 63, 133, 137, 142

[56] References Cited

U.S. PATENT DOCUMENTS

| | | | |
|---|---|---|---|
| 4,842,268 | 6/1989 | Jenkins | 482/62 |
| 4,986,261 | 1/1991 | Iams et al. | 482/142 |
| 5,180,348 | 1/1993 | Saarinen | 482/63 |
| 5,356,356 | 10/1994 | Hildebrandt et al. | 482/62 |
| 5,445,583 | 8/1995 | Habing | 482/52 |
| 5,542,893 | 8/1996 | Peterson et al. | 482/62 |

*Primary Examiner*—Stephen R. Crow
*Attorney, Agent, or Firm*—The Kline Law Firm

[57] ABSTRACT

A full body reciprocating aerobic exercise machine that forces all of a user's limbs to move during the exercise. Because all the leg and arm levers move in unison, it allows a user to maintain the proper exercise motion even with an injured, incapacitated, or missing limb. The machine simulates uphill running or walking, and eliminates any joint impact to the user. The machine includes a central torso stabilization support, two leg levers, and two arm levers. The torso support and the leg and arm levers are mounted on a machine base. The leg and arm levers are rotatable through a limited but large arc relative to the torso support. The levers are synchronized so that the left leg lever must move with the right arm lever, and the right leg lever must move with the left arm lever, and so that all four levers move simultaneously. Because of this synchronization, the machine utilizes a "cross-crawl" motion that is completely natural to any user. A user's learning time is therefore minimized.

10 Claims, 4 Drawing Sheets

RECIPROCATING EXERCISE MACHINE

FIELD OF THE INVENTION

The present invention relates generally to exercise equipment, and more particularly is a full-body, reciprocating exercise machine.

BACKGROUND OF THE INVENTION

Most exercise equipment is designed with a relatively specific purpose in mind. For example, the present invention is directed to aerobic exercise. While there are numerous prior art devices directed to providing a user with aerobic exercise, most of the currently available art suffers from one or more of the following shortcomings:

Many machines provide only exercise for a limited number of major muscle groups, and/or the range of motion provided in the exercise is limited. This means that this type of equipment is at best designed to be used in conjunction with other machines, and cannot provide a full aerobic workout.

Some machines, particularly those designed to simulate running, include the drawbacks of running such as high impact on the user's joints. It is well known that high impact exercises can easily lead to injuries. It is also critical for injury avoidance that the exercise machine not induce any additional stress on a user's back.

Finally, many exercise machines have a relatively long learning curve. Because the exercise motion that the machines use is foreign to a user, the user must learn the motion before he can achieve any effective exercise. This can be discouraging to a user, particularly to a novice.

There are several examples in the prior art of aerobic exercise machines that are directed to providing a full body aerobic workout for the user. Following are some examples:

The "Recumbent Total Body Exerciser", by Hildebrandt et al., U.S. Pat. No. 5,356,356, issued Oct. 18, 1994. This device positions a user in a seated position and does provide the opportunity for a full-body workout. One of the drawbacks of this, and many of the stationary bikes, is that the driving impetus for the upper body portion of the workout must be provided solely through the hands. Since the hands are the weakest, most fragile parts of the upper body, providing driving impetus solely through the hands leads to an increased possibility of injury to the user. Moreover, the user's hands are likely to tire before an efficient workout is accomplished.

Another shortcoming of machines such as the Hildebrandt et al. device is that it does not support the user's back. In that it is estimated that 80–90% of all adults will experience back problems at some time in their lives, this is a rather serious issue.

One exercise machine that provides a means for back support is the "Apparatus for Performing Coordinated Walking Motions with the Spine in an Unloaded State" by Iams et al., U.S. Pat. No. 4,986,261, issued Jan. 22, 1991. This machine places the user in a completely supine position, which removes any load from the user's back. However, a user of this machine is placed in an unnatural position for exercise, and thereby requires some learning period to feel comfortable using the machine. Moreover, the upper body exercise must again be obtained solely through the hands.

Another device directed to a cycling motion exercise is the "Floating Back Pad Leg Exerciser" by Habing, U.S. Pat. No. 5,445,583, issued Aug. 29, 1995. This machine does provide back support with a "floating" back pad which moves with the user. However, there is no means for exercise of the upper body.

Accordingly, it is an object of the present invention to provide an aerobic exercise machine that allows the user to achieve full-body exercise.

It is another object of the present invention to provide a machine that allows the user to maintain the exercise motion even with an injured, incapacitated, or missing limb.

It is a further object of the present invention to provide the user with adequate back support so that additional stress is not placed on the user's back.

It is a still further object to provide a means for a user to achieve a full-body workout without applying undue stress to the user's hands.

Finally, it is an object of the present invention to provide a machine that is space efficient and aesthetically pleasing. Moreover, the machine must be easily manufactured and durable.

SUMMARY OF THE INVENTION

The present invention is a full body reciprocating aerobic exercise machine that forces all of a user's limbs to move during the exercise. Because all the leg and arm levers move in unison, it allows a user to maintain the proper exercise motion even with an injured, incapacitated, or missing limb. The machine simulates uphill running or walking, and eliminates any joint impact to the user. The machine includes a central torso stabilization support, two leg levers, and two arm levers. The torso support and the leg and arm levers are mounted on a machine base.

The leg and arm levers are rotatable through a limited but large arc relative to the torso support. The levers are synchronized so that the left leg lever must move with the right arm lever, and the right leg lever must move with the left arm lever, and so that all four levers move simultaneously. Because of this synchronization, the machine utilizes a "cross-crawl" motion that is completely natural to any user. A user's learning time is therefore minimized.

An advantage of the present invention is that it provides a full-body exercise that is very easy for a user to learn due to the utilization of a natural "cross-crawl" motion.

Another advantage of the present invention is that it provides effective support to the user's back at all times.

A still further advantage of the present invention is that the amount of exercise obtained from the machine is not dependent on hand or grip strength.

Yet another advantage of the present invention is that the arm levers are synchronized with the leg levers.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
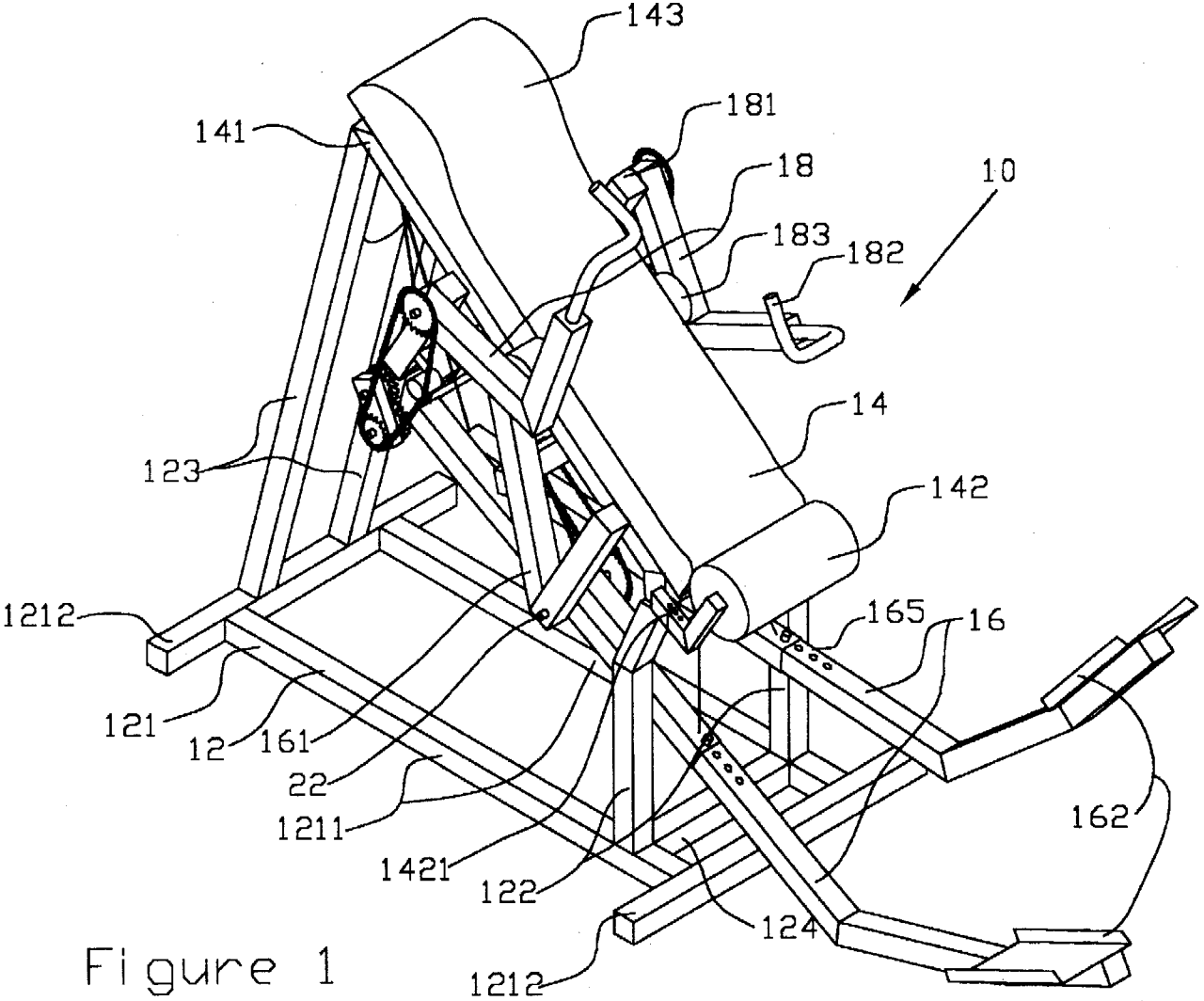
FIG. 1 is a front right side perspective view of the full body reciprocating aerobic exercise machine of the present invention.

Referring first to FIG. 1, the present invention is a full body reciprocating aerobic exercise machine 10. The machine 10 comprises chiefly a base 12, a torso stabilization means 14, two leg levers 16, two arm levers 18, and a drive mechanism 20.

The base 12 comprises a horizontal support platform 121. In the preferred embodiment, the horizontal support platform 121 includes two parallel longitudinal support bars 1211 and two transverse support bars 1212. The transverse support bars 1212 are located one at either end of the longitudinal support bars 1211.

Affixed near a front end of the base 12 are two upward extending front torso platform support legs 122. Positioned near a rear end of the base 12 are two upward extending rear torso platform support legs 123. One or more reinforcing cross members 124 may be added to the base for additional support and stability.

A torso stabilization platform 14 is mounted on the front 122 and the rear 123 torso platform support legs. The stabilization platform 14 is mounted on the support legs 122, 123 so that the platform 14 is at an approximately 40° angle relative to horizontal. An upper end of the stabilization platform 14 includes a headrest 143. A support frame 141 is affixed to the underside of the stabilization platform 14 to provide a stable and convenient means of anchoring the stabilization platform 14 to the base 12 via the support legs 122, 123.

Also affixed either to the support frame 141 or to the base 12 is a seat means 142. The seat means 142 is positioned to support a user's hips so that he does not slide downward along the stabilization platform 14. The seat means 142 includes an adjustment means 1421 to allow the user to slide the seat means 142 in a plane parallel to that of an upper surface of the stabilization platform 14. This allows users of varying heights to comfortably reach the leg levers 16 and the arm levers 18, and to have their shoulders positioned at the proper level for exercise.

The leg levers 16 are pivotally attached to a leg lever mounting bracket 161 that is affixed to the support frame 141. The leg levers 16 pivot about a lower body drive axle 22. The lower body drive axle 22 is supported by the mounting bracket 161. The lower axle 22 provides a pivot point for the leg levers 16. A rear end of each of the leg levers 16 is connected to an adjustable resistance mechanism 24. The resistance mechanism 24 can be set to provide the level of resistance desired by the user. In the preferred embodiment, the resistance mechanism 24 is a friction device connected to the leg levers by cable 241. The resistance mechanism 24 can be adjusted by the user to create more or less resistance to the user's exercise. It is understood that the resistance device can be attached to any of the moving parts of the machine with the same effect, and that any known resistance mechanism will suffice.

The leg levers 16 are angled upward as they emerge from the underside of the stabilization platform 14. The leg levers 16 then angle upward again near a front end of the lever 16. The front end of the lever 16 is provided with a foot plate 162 to receive the user's foot. A pulley 163 is affixed to the underside of the support frame, and receives a cable 164 that is affixed to both leg levers 16. The pulley 163 and the cable 164 reduce stress on the gearing system, and provide a direct, physical synchronization means between the two opposing leg levers 16. Adjustment means 165 allow the user to position the leg levers appropriately for the user's leg length.

The arm levers 18 are pivotally mounted on an arm lever mounting bracket 181 that is affixed to either the support frame 141 or the base 12. The arm levers 18 are rounded inward, with hand grips 182 extending upward from distal ends thereof. An upper arm pad 183 is provided on each lever to receive the user's upper arm. It is intended that the driving impetus applied by the user's upper body be applied chiefly through the upper arm pads 183 and the inwardly curved portion of the arm levers 18. The hand grips 182 are intended only to maintain the user's arms in the proper position, keeping his forearms comfortably mounted on the curved portions of the arm levers 18. This allows the user to supply driving impetus through his shoulders and arms as opposed to through his hands.

The leg levers 16 and the arm levers 18 are kept in contralateral synchronization by means of the drive mechanism 20. While the drive mechanism 20 may take many forms, in the preferred embodiment 10, the drive mechanism is chiefly comprised of a plurality of gears and chains.

Two lower body drive gears 201,202 are mounted on the lower axle 22 and are driven by the leg levers 16. A first lower drive chain 203 is driven by a first of the lower body drive gears 201, and a second lower drive chain 204 is driven by a second of the lower body drive gears 202. The drive gears 201,202 are of course driven by the leg levers 16. The lower drive gears 201,202 are mounted on the lower axle 22 by separate bushings so as to turn independently.

Figure 2:
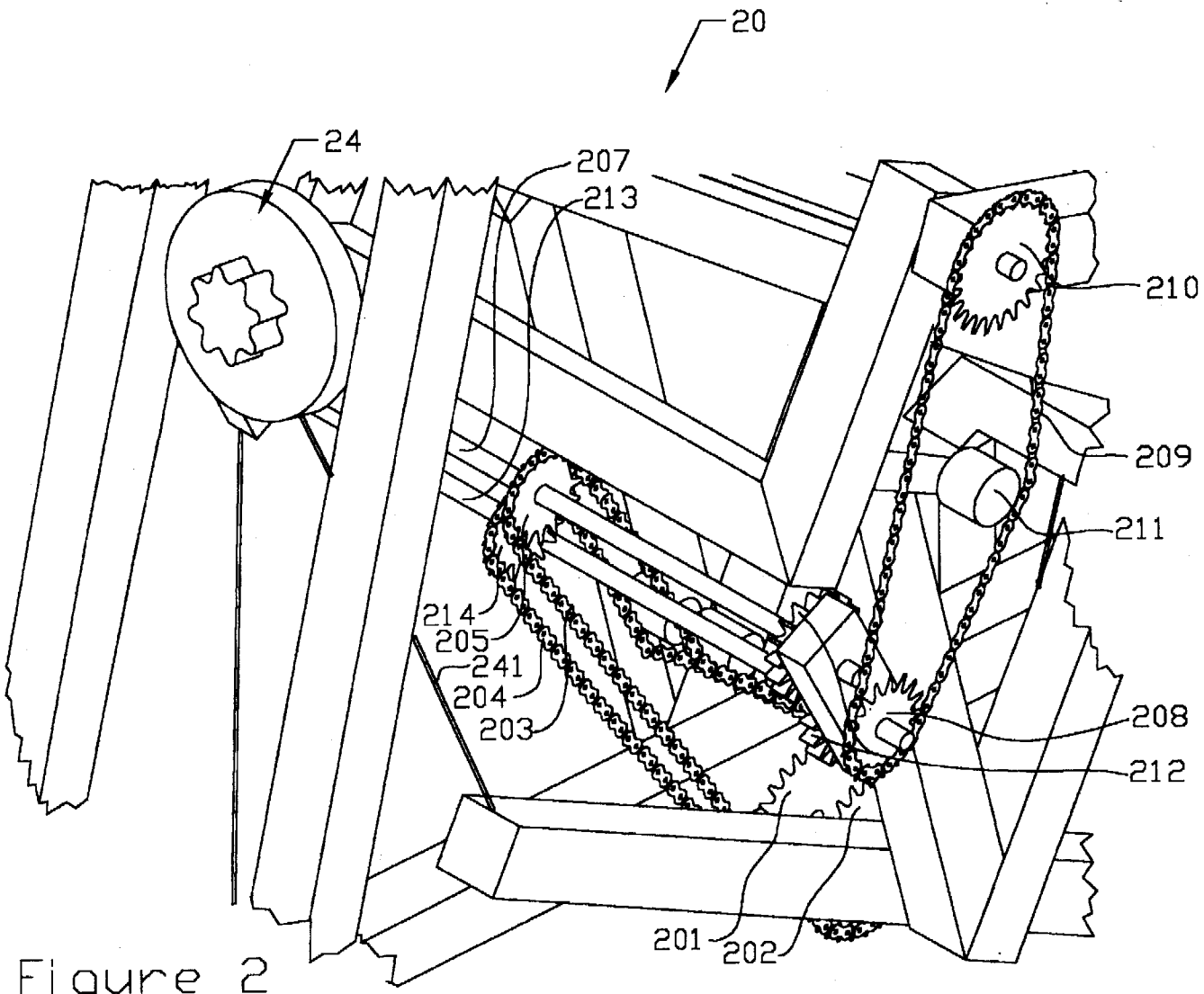
FIG. 2 is a detailed view of the right side drive mechanism.

Referring now to FIG. 2, the lower drive chains 203,204 are in communication with corresponding upper body drive gears. Because of the contralateral synchronization of the device, each lower drive chain is in communication with an upper body, or arm, drive gear on an opposite side of the machine. Thus, the first lower drive chain 203, powered by the left leg lever, is in communication with the right arm lever through the gearing system.

The first lower drive chain 203 is mounted on a first connecting gear 205 that is affixed to a first upper axle 207. The first upper axle 207 turns a first arm drive gear 208. A first upper drive chain 209 is mounted between the first connecting gear 205 and a first arm gear 210 affixed at the pivot point of a first of the arm levers.

A chain tightener 211 is used to adjust the tension of the chain 209. Similar chain tighteners are utilized for the lower drive chains and the second upper drive chains.

To ensure synchronization of the levers of the machine, reverser gears 212 are mounted on the first upper axle 207 and a second upper axle 213. The teeth of the reverser gears 212 are meshed so that the first upper axle must rotate in a first direction an amount equal to the rotation of the second upper axle in the opposite direction. Because the leg levers are connected to the upper axles via the lower drive chains 203, 204, the leg levers are similarly synchronized with the arm levers.

Figure 3:
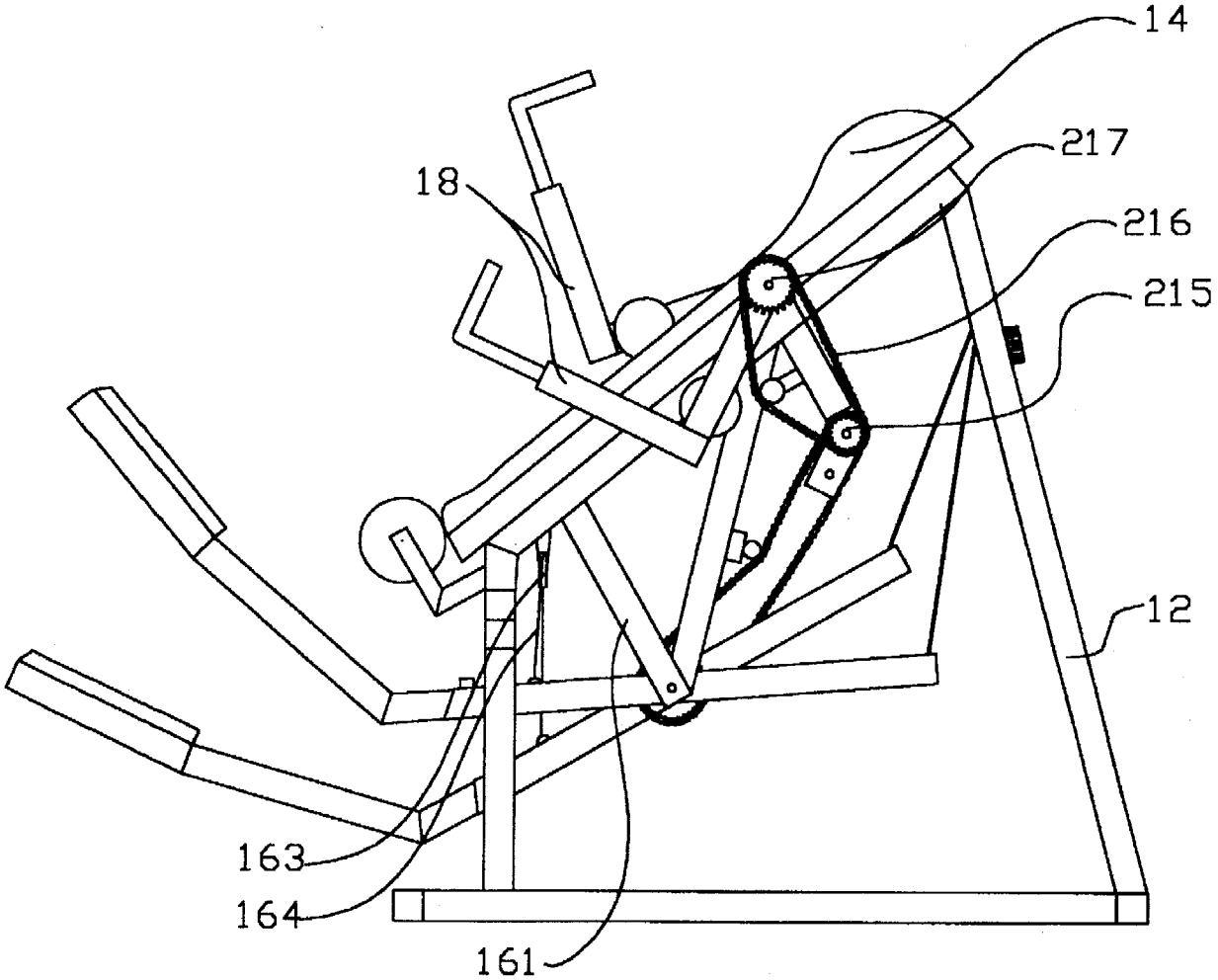
FIG. 3 is a left side view of the full body reciprocating aerobic exercise machine of the present invention.

The second lower drive chain 204 is connected to a second of the arm levers by an identical gearing system. The second lower drive chain 204 is mounted on a second connecting gear 214 that is affixed to the second upper axle 213. The second upper axle 213 turns a second arm drive gear 215. A second upper drive chain 216 is mounted between the second connecting gear and a second arm gear 217 affixed at the pivot point of a second of the arm levers. The second half of the drive mechanism can be seen in FIG. 3.

The leg and arm levers are rotatable through a limited but large arc relative to the torso support. The arc may be established at any desired size by the manufacturer of the machine by moving physical stops for the arm and leg levers. Depending on the size of the arc chosen, different gears may be required in the gearing mechanism to allow smooth operation.

In the preferred embodiment, the leg levers move through an approximately 50° arc and the arm levers move through approximately 100°. It is readily recognized that the range of motion provided by the machine can vary depending on the limb length of the user. It is further recognized that each individual user may vary his range of motion depending upon the stride he may choose on any given day.

The leg and arm levers are synchronized through the gearing system so that the left leg lever must move with the right arm lever, and the right leg lever must move with the left arm lever, and so that all four levers move simultaneously. Because of this synchronization, the machine utilizes a "cross-crawl" motion that is completely natural to any user. A user's learning time is therefore minimized.

FIRST ALTERNATE EMBODIMENT

Figure 4:
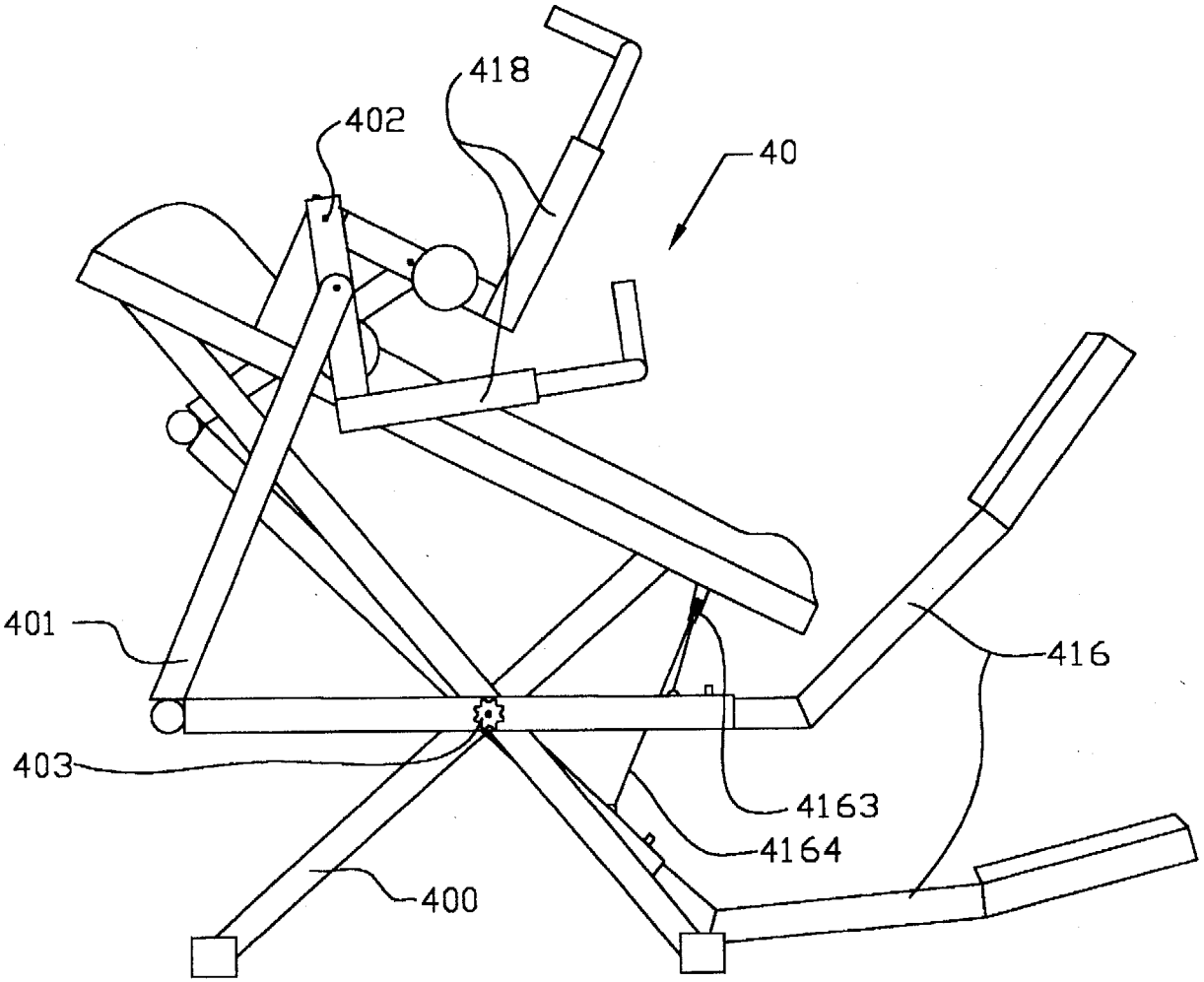
FIG. 4 is a left side perspective view of an alternate embodiment of the exercise machine of the present invention.

FIG. 4 illustrates a first alternate embodiment 40 of the machine that utilizes a system of interlocking rods as the driving means for the leg 416 and arm 418 levers. A pulley 4163 and cable 4164 are again used to support the weight of the leg levers 416, and to physically connect the leg levers 416.

The machine 40 is supported by a collapsible central base 400. The base 400 is collapsible so that the machine may be stored in a small space. Each leg lever 416 is in communication with a corresponding arm lever 418 via a connecting rod 401. The connecting rod 401 is affixed to the arm lever 418 at a point below the pivot point 402 of the arm lever. The arms are removably attached at the pivot points 402 to further enhance the collapsing effect of the machine for storage.

Because of the physical connection of the elements, the leg levers 416 and the arm levers 418 of the alternate embodiment 40 also move in contralateral synchronization. The first alternate embodiment also includes some form of resistance mechanism 403. In this embodiment, the resistance mechanism is an adjustable tension knob affixed to the pivot point of the leg levers. Again, any form of resistance mechanism affixed to any of the moving parts will suffice.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A full body reciprocating aerobic exercise machine comprising:

a base, a means to stabilize a torso of a user, two leg levers, two arm levers, at least one pulley means and at least one cable means, a drive mechanism, and an adjustable resistance mechanism; wherein said leg levers and said arm levers are synchronized through said drive mechanism so that a left leg lever must move with a right arm lever, and a right leg lever must move with a left arm lever, said drive mechanism further requiring that all four leg and arm levers move simultaneously, and said pulley means is affixed to an underside of a support frame, said pulley means receives a cable means that is affixed to both leg levers, thereby reducing stress on said drive mechanism, said pulley means and said cable means provide a direct, physical synchronization means between said two opposing leg levers, and said leg levers and said arm levers are in communication with said adjustable resistance mechanism, said resistance mechanism can be set to provide a level of resistance desired by the user; wherein said drive mechanism comprises two lower body drive gears mounted on a said lower axle and are driven by said leg levers, a first lower drive chain is driven by a first of said lower body drive gears, and a second lower drive chain is driven by a second of said lower body drive gears, said lower body drive gears are driven by said leg levers, said lower drive chains are in communication with corresponding upper body drive gears, each lower drive chain is in communication with an upper body drive gear on an opposite side of said machine, said first lower drive chain is mounted on a first connecting gear that is affixed to a first upper axle, said first upper axle turns a first upper body arm drive gear, a first upper drive chain is mounted between said first connecting gear and a first arm gear affixed at a pivot point of a first of said arm levers, reverser gears are mounted on said first upper axle and a second upper axle, teeth of said reverser gears are meshed so that said first upper axle must rotate in a first direction an amount equal to the rotation of said second upper axle in an opposite direction, said leg levers are connected to said upper axles via said lower drive chains such that said leg levers are synchronized with said arm levers, said second lower drive chain is mounted on a second connecting gear that is affixed to said second upper axle, said second upper axle turns a second arm drive gear, a second upper drive chain is mounted between said second connecting gear and a second arm gear affixed at a pivot point of a second of said arm levers.

2. The full body reciprocating aerobic exercise machine as defined in claim 1 wherein:

said resistance mechanism is a friction device.

3. The full body reciprocating aerobic exercise machine as defined in claim 1 wherein:

said resistance mechanism is an electromagnetic device.

4. The full body reciprocating aerobic exercise machine as defined in claim 1 wherein:

said drive mechanism is a series of interlocking rods, each said leg lever is in communication with a corresponding arm lever via a connecting rod, each said connecting rod is affixed to one of said arm lever at a point below a pivot point of said arm lever, said arm levers are removably attached at said pivot points.

5. The full body reciprocating aerobic exercise machine as defined in claim 4 wherein:

said base is collapsible so that said machine may be stored in a small space.

6. The full body reciprocating aerobic exercise machine as defined in claim 4 wherein:

said resistance mechanism further includes an adjustable tension knob affixed to a pivot point of said leg levers.

7. A full body reciprocating aerobic exercise machine comprising:

a base, a means to stabilize a torso of a user, two leg levers, two arm levers, at least one pulley means and at least one cable means, a drive mechanism, and an adjustable friction resistance mechanism; wherein said leg levers and said arm levers are synchronized through said drive mechanism so that a left leg lever must move with a right arm lever, and a right leg lever must move with a left arm lever, said drive mechanism further requiring that all four leg and arm levers move simultaneously and said pulley means is affixed to an underside of a support frame, said pulley means receives a cable means that is affixed to both leg levers, thereby reducing stress on said drive mechanism, said pulley means and said cable means provide a direct, physical synchronization means between said two opposing leg leversl and said leg levers and said arm levers are in communication with said adjustable friction resistance mechanism, said friction resistance mechanism can be set to provide a level of resistance desired by the user; wherein said drive mechanism comprises two lower body drive gears mounted on a said lower axle and are driven by said leg levers, a first lower drive chain is driven by a first of said lower body drive gears, and a second lower drive chain is driven by a second of said lower body drive gears, said lower body drive gears are driven by said leg levers, said lower drive chains are in communication with corresponding upper body drive gears, each lower drive chain is in communication with an upper body drive gear on an opposite side of said machine, said first lower drive chain is mounted on a first connecting gear that is affixed to a first upper axle, said first upper axle turns a first upper body arm drive gear, a first upper drive chain is mounted between said first connecting gear and a first arm gear affixed at a pivot point of a first of said arm levers, reverser gears are mounted on said first upper axle and a second upper axle, teeth of said reverser gears are meshed so that said first upper axle must rotate in a first direction an amount equal to the rotation of said second upper axle in an opposite direction, said leg levers are connected to said upper axles via said lower drive chains such that said leg levers are synchronized with said arm levers, said second lower drive chain is mounted on a second connecting gear that is affixed to said second upper axle, said second upper axle turns a second arm drive gear, a second upper drive chain is mounted between said second connecting gear and a second arm gear affixed at a pivot point of a second of said arm levers.

8. A full body reciprocating aerobic exercise machine comprising:

a base, a means to stabilize a torso of a user, two leg levers, two arm levers, at least one pulley means and at least one cable means, a drive mechanism, and an adjustable friction resistance mechanism; wherein said leg levers and said arm levers are synchronized through said drive mechanism so that a left leg lever must move with a right arm lever, and a right leg lever must move with a left arm lever, said drive mechanism further requiring that all four leg and arm levers move simultaneously, and said pulley means is affixed to an underside of a support frame, said pulley means receives a cable means that is affixed to both leg levers, thereby reducing stress on said drive mechanism, said pulley means and said cable means provide a direct, physical synchronization means between said two opposing leg levers, and said leg levers and said arm levers are in communication with said adjustable resistance mechanism, said resistance mechanism can be set to provide a level of resistance desired by the user; wherein said drive mechanism is a series of interlocking rods, each said leg lever is in communication with a corresponding arm lever via a connecting rod, each said connecting rod is affixed to one of said arm levers at a point below a pivot point of said arm lever, said arm levers are removably attached at said pivot points.

9. The full body reciprocating aerobic exercise machine as defined in claim 8 wherein:

said base is collapsible so that said machine may be stored in a small space.

10. The full body reciprocating aerobic exercise machine as defined in claim 8 wherein:

said resistance mechanism further includes an adjustable tension knob affixed to a pivot point of said leg levers.

* * * * *